US009202421B2

(12) United States Patent
Yamamura et al.

(10) Patent No.: US 9,202,421 B2
(45) Date of Patent: Dec. 1, 2015

(54) DISPLAY DEVICE AND METHOD FOR CONTROLLING DISPLAY DEVICE FOR REDUCING CURRENT REQUIREMEENTS FOR DRIVING LIGHT SOURCE UNITS

(71) Applicant: Panasonic Liquid Crystal Display Co., Ltd., Hyogo (JP)

(72) Inventors: Akihiro Yamamura, Osaka (JP); Isao Matsuda, Osaka (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 301 days.

(21) Appl. No.: 13/869,588

(22) Filed: Apr. 24, 2013

(65) Prior Publication Data

US 2013/0278651 A1 Oct. 24, 2013

(30) Foreign Application Priority Data

Apr. 24, 2012 (JP) ..... 2012-098561

(51) Int. Cl.
*G09G 3/36* (2006.01)
*G09G 3/34* (2006.01)

(52) U.S. Cl.
CPC ..... *G09G 3/36* (2013.01); *G09G 3/3426* (2013.01); *G09G 3/342* (2013.01); *G09G 2310/024* (2013.01); *G09G 2320/064* (2013.01); *G09G 2320/0633* (2013.01); *G09G 2330/025* (2013.01)

(58) Field of Classification Search
CPC ..... G09G 3/342
USPC ..... 345/102
See application file for complete search history.

(56) References Cited

U.S. PATENT DOCUMENTS

| | | | | |
|---|---|---|---|---|
| 7,218,307 | B1 * | 5/2007 | Chao | 345/102 |
| 2003/0020677 | A1 * | 1/2003 | Nakano | 345/87 |
| 2004/0252097 | A1 * | 12/2004 | Kaneki et al. | 345/102 |
| 2005/0083282 | A1 * | 4/2005 | Honbo | 345/87 |
| 2006/0208998 | A1 * | 9/2006 | Okishiro et al. | 345/102 |
| 2007/0176883 | A1 * | 8/2007 | Hsu et al. | 345/102 |
| 2007/0262732 | A1 * | 11/2007 | Shen | 315/312 |
| 2007/0273678 | A1 * | 11/2007 | Okita et al. | 345/204 |
| 2008/0258639 | A1 * | 10/2008 | Kim | 315/291 |
| 2009/0108774 | A1 * | 4/2009 | Jang | 315/297 |
| 2010/0001944 | A1 * | 1/2010 | Seong et al. | 345/102 |
| 2011/0273480 | A1 * | 11/2011 | Park et al. | 345/102 |
| 2012/0105441 | A1 * | 5/2012 | Park | 345/690 |

FOREIGN PATENT DOCUMENTS

JP 2008-091311 A 4/2008

* cited by examiner

*Primary Examiner* — Adam J Snyder
(74) *Attorney, Agent, or Firm* — McDermott Will & Emery LLP

(57) ABSTRACT

A display device has a display panel and a backlight unit. The backlight unit includes first and second light source units, and a control unit that outputs a drive signal to the light source units to drive the first and second light source units during first and second drive periods in one frame period respectively. The control unit drives the light source units so that the one frame period has an overlapped period, in which the first and second drive periods overlap. The control unit outputs PWM signals to turn the light source units on and off to the light source units respectively. The control unit shifts a phase of the PWM signal to be outputted to the first light source unit and a phase of the PWM signal to be outputted to the second light source unit from each other.

5 Claims, 6 Drawing Sheets

DISPLAY DEVICE AND METHOD FOR CONTROLLING DISPLAY DEVICE FOR REDUCING CURRENT REQUIREMEENTS FOR DRIVING LIGHT SOURCE UNITS

RELATED APPLICATIONS

This application claims the benefit of Japanese Application No. 2012-098561, filed on Apr. 24, 2012, the disclosures of which Applications are incorporated by reference herein.

BACKGROUND

1. Technical Field

This disclosure relates to a display device having a backlight unit that illuminates a display panel from the rear face, and a method for controlling the display device.

2. Description of the Related Art

A display device, having a display panel that uses non-self-light-emitting liquid crystal as a light modulation element, includes a backlight unit that illuminates the display panel from the rear face, and displays arbitrary images by controlling the transmittance of the light emitted from the backlight unit using the liquid crystal. For the light source of the backlight unit, light emitting diodes, for example, are used, hence various techniques to control driving of the light emitting diodes have been proposed (e.g. see Japanese Patent Application Laid-Open No. 2008-91311).

In the case of the light emitting diode drive device according to Japanese Patent Application Laid-Open No. 2008-91311, a plurality of light emitting diodes are connected in parallel, and when pulsed current is applied to each light emitting diode sequentially at a predetermined interval with a same pulse width, a cycle of applying pulsed current is sequentially shifted by a predetermined cycle in each light emitting diode connected in parallel. If all the light emitting diodes were driven at a same timing, pulsed driving control with large current as a whole would be performed, which would cause noise to occur. However, the above-described control can reduce noise to occur.

In this technique disclosed in Japanese Patent Application Laid-Open No. 2008-91311 however, light emitting diodes are turned ON with a predetermined brightness during one frame period, and there is an overlapped period in which the respective periods of being turned on overlap among the light emitting diodes connected in parallel. Therefore, the current capacity required for driving the light emitting diodes increases by an amount equal to the number of light emitting diodes that simultaneously turn ON in the overlapped period, compared with the case where there is no overlapped period. Accordingly, the cost required for driving the light emitting diodes increases.

In a display device, in which the display unit is segmented into a plurality of areas, including a backlight unit which has a plurality of light source units for illuminating each of the plurality of areas, using a black insertion technique is known, in which a period to display a black image by turning all the light source units off is provided in one frame period, or a period to display a black image in an area of a part of the display unit is provided by shifting the phase to turn each of the light source units on, respectively. With this technique, display of the display device using hold type liquid crystal can be closer to the impulse type display, so as to improve the resolution of video images. In a display device using this technique as well, the brightness in one frame period must be kept at a predetermined level or more. Further, as the power supply unit to drive this light source unit, a power supply unit having a current capacity matching with the overlapped period, in which a plurality of light source units are turned on simultaneously, must be provided. Recently, the current capacity required for the overlapped period, where a plurality of light source units are turned on simultaneously, is increasing, since high brightness in a short light on time is demanded for each light source unit. Therefore, the load on the light source units is becoming excessive.

SUMMARY

In one general aspect, the present application describes a display device includes a display panel that displays a frame image for each one frame period; and a backlight unit that illuminates the display panel from a rear face of the display panel, wherein the backlight unit includes: a first light source unit that illuminates the display panel; a second light source unit that illuminates the display panel; and a control unit that outputs a drive signal to the first light source unit to drive the first light source unit during a first drive period in the one frame period, and a drive signal to the second light source unit to drive the second light source unit during a second drive period in the one frame period after the driving of the first light source unit is started, and the control unit: drives the first light source unit and the second light source unit so that the one frame period has an overlapped period, in which the first drive period and the second drive period overlap each other; outputs a PWM signal as the drive signal to the first light source unit in the overlapped period, and a PWM signal as the drive signal to the second light source unit in the overlapped period, each of the PWM signals turning the first light source unit and the second light source unit on and off with a predetermined pulse width; and shifts a phase of the PWM signal to be outputted to the first light source unit and a phase of the PWM signal to be outputted to the second light source unit from each other.

An another general aspect may include a method for controlling a display device that has a display panel which displays a frame image for each one frame period, and a backlight unit that illuminates the display panel from a rear face of the display panel, the backlight unit including a first light source unit that illuminates the display panel, and a second light source unit that illuminates the display panel, the method comprising: a first step of outputting a drive signal to the first light source unit to drive the first light source unit during a first drive period in the one frame period; and a second step of outputting a drive signal to the second light source unit to drive the second light source unit during a second drive period in the one frame period after the driving of the first light source unit is started, wherein the first light source unit and the second light source unit are driven in the first step and the second step so that the one frame period has an overlapped period, in which the first drive period and the second drive period overlap each other, a PWM signal is outputted, as the drive signal, to the first light source unit in the overlapped period in the first step, the PWM signal turning the first light source unit on and off with a predetermined pulse width, a PWM signal is outputted, as the drive signal, to the second light source unit in the overlapped period in the second step, the PWM signal turning the second light source unit on and off with a predetermined pulse width, and a phase of the PWM signal to be outputted to the first light source unit and a phase of the PWM signal to be outputted to the second light source unit are shifted from each other in the first step and the second step.

According to the display device and the method for controlling the display device of the present application, in the overlapped period, a PWM signal, to turn the first and second light source units on and off with a predetermined pulse width, is outputted, and the phase of the PWM signal to be outputted to the first light source unit and the phase of the PWM signal to be outputted to the second light source unit are shifted from each other. Therefore, even though the one frame period has the overlapped period, the degree of increase of the current capacity required for the first and second light source units can be decreased compared with the case where the first and second light source units are turned on at a constant brightness and the drive periods overlap. Therefore, the increase of current capacity required for driving the first and second light source units in the overlapped period can be suppressed. As a result, an increase in the cost required for driving the first and second light source units can be suppressed, and the load on the power supply unit can be decreased.

DETAILED DESCRIPTION

A display device according to an embodiment of the present application will now be described with reference to the drawings.

(First Embodiment)

Figure 1:
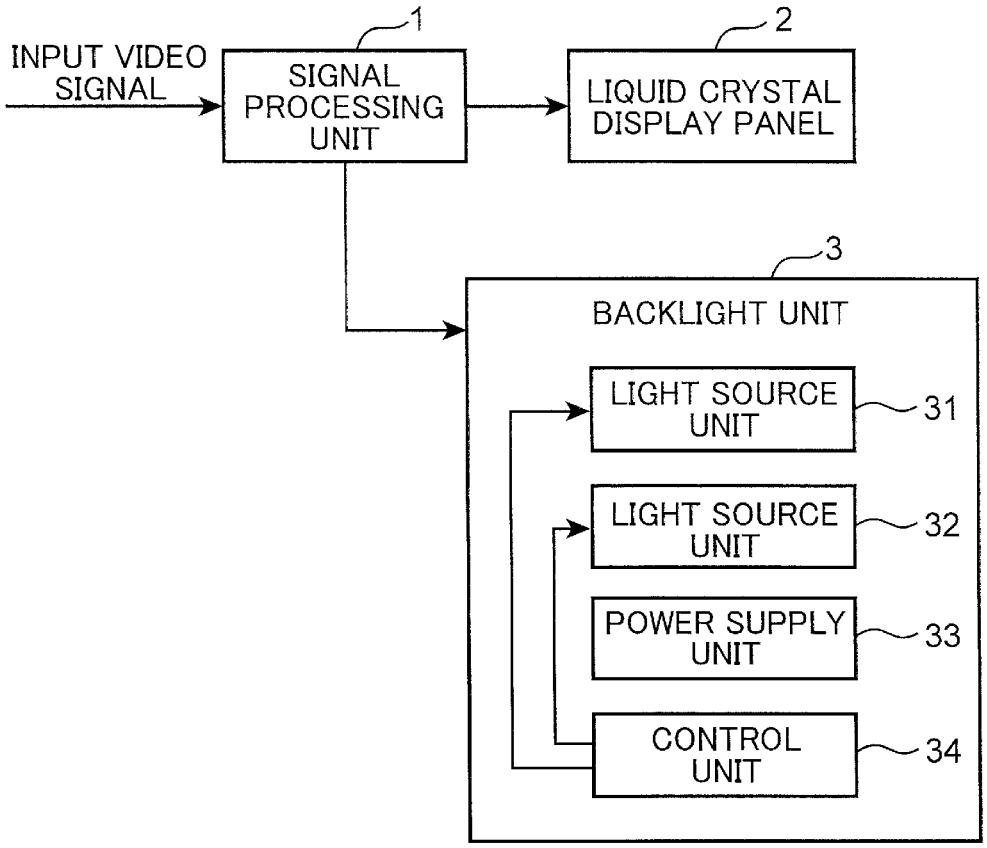
FIG. 1 is a block diagram depicting a configuration of a display device according to a first embodiment of the present application.
Figure 2:
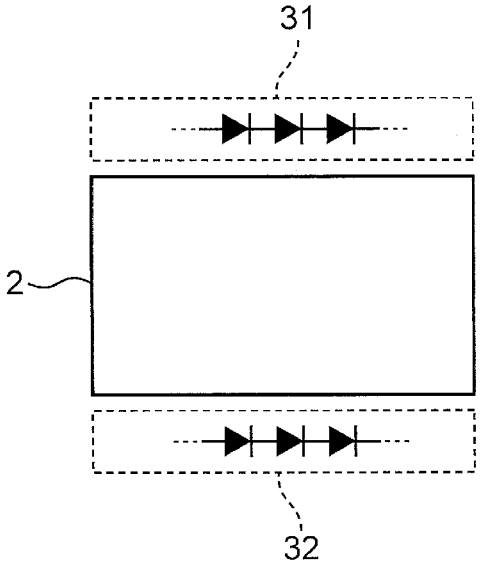
FIG. 2 is a schematic diagram depicting an arrangement of the light source units of the backlight unit according to the first embodiment.

FIG. 1 is a block diagram depicting a configuration of a display device according to a first embodiment of the present application. FIG. 2 is a schematic diagram depicting an arrangement of the light source units of a backlight unit according to the first embodiment.

A display device shown in FIG. 1 has a signal processing unit 1, a liquid crystal display panel 2, and a backlight unit 3. Based on an input video signal from the outside, the signal processing unit 1 generates a control signal to control the liquid crystal display panel 2 and a control signal to control the backlight unit 3, and outputs the control signals to the liquid crystal display panel 2 and the backlight unit 3 respectively. Although not illustrated in FIG. 1, the liquid crystal display panel 2 has a plurality of gate lines that extend in the horizontal direction, a plurality of source lines that extend in the vertical direction, switching elements and a plurality of pixels, where the plurality of pixels are arranged in a matrix at intersections of the plurality of source lines and the plurality of gate lines.

Based on a control signal outputted from the signal processing unit 1, image data is written once for each frame sequentially from the pixel at the top edge to the pixel at the bottom edge of the liquid crystal display panel 2 in FIG. 2 for example, out of the pixels arranged in a matrix on the liquid crystal display panel 2. The liquid crystal display panel 2 is a hold type display unit which holds the written image data for one frame period until the next image data is written. In this way, the liquid crystal display panel 2 displays a frame image for each frame period based on the control signal outputted from the signal processing unit 1. For the liquid crystal display panel 2 of the display device of this embodiment, any driving type liquid crystal display panel, including in plane switching (IPS) and vertical alignment (VA) can be used. In this embodiment, for example, the IPS type liquid crystal display panel is used.

The backlight unit 3 illuminates the liquid crystal display panel 2 from the rear face of the liquid crystal display panel 2. For the backlight unit 3, the display device of this embodiment may use either one of the edge light illumination type backlight unit and the direct illumination type backlight unit. In this embodiment, for example, an edge light type backlight unit is used. The backlight unit 3 includes light source units 31 and 32, a power supply unit 33 and a control unit 34.

As shown in FIG. 2, the light source unit 31 includes a plurality of light emitting diodes (LEDs) connected in series, for example. The plurality of LEDs of the light source unit 31 are arranged along the top edge of the liquid crystal display panel 2. The light source unit 31 illuminates an upper half portion of the liquid crystal display panel 2. Similarly to the light source unit 31, the light source unit 32 also includes a plurality of light emitting diodes (LEDs) connected in series, for example. The plurality of LEDs of the light source unit 32 are arranged along the bottom edge of the liquid crystal display panel 2. The light source unit 32 illuminates the lower half portion of the liquid crystal display panel 2. The power supply unit 33 supplies power to the light source units 31 and 32 and the control unit 34.

The control unit 34 controls turning on-off of the light source units 31 and 32 respectively. The control unit 34 sets a light-up duty ratio with respect to one frame period of the light source units 31 and 32 respectively, based on the control signal which is outputted from the signal processing unit 1. In a case where the brightness of a frame image to be displayed on the liquid crystal display panel 2 is high for example, the control unit 34 sets the light-up duty ratio to a higher value than in a case where the brightness is low. Further, in a case where the brightness around the liquid crystal panel 2 is high for example, the control unit 34 sets the light-up duty ratio to a higher value than in a case where the brightness is low. Based on the light-up duty ratio that is set, the control unit 34 determines a drive period to drive the light source units 31 and 32 respectively. The control unit 34 outputs a drive signal to the light source units 31 and 32 to drive to turn the light source unit 31 and 32 on during the determined drive period. The light-up duty ratio is given by the expression, light-up duty ratio=(drive period/1 frame period).

Figure 3:
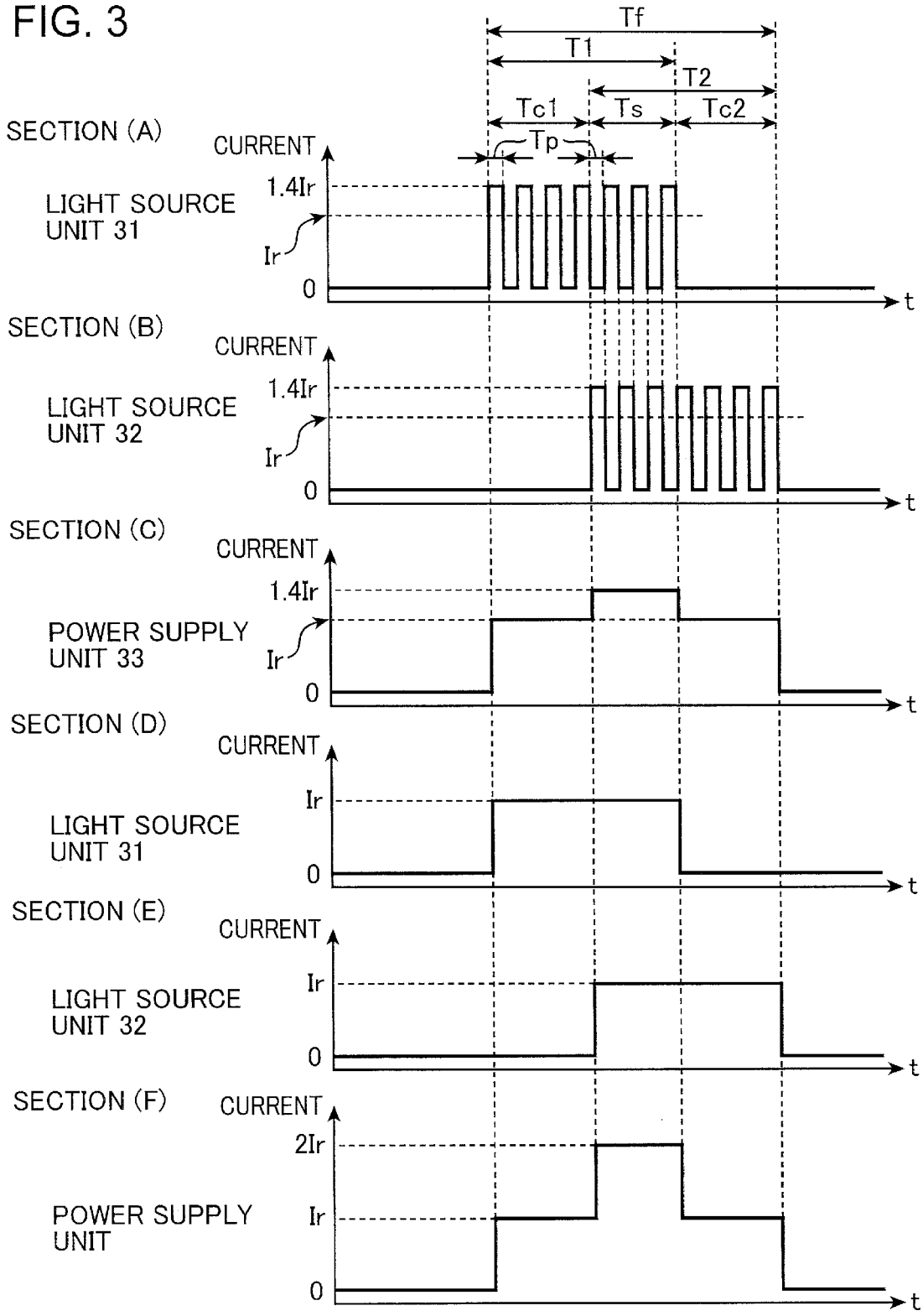
FIG. 3 is a timing chart depicting an example of the driving operation of the light source units performed by the control unit in the display device shown in FIG. 1.

FIG. 3 is a timing chart depicting an example of the driving operation of the light source units 31 and 32 performed by the control unit 34 in the display device shown in FIG. 1. Section (A) in FIG. 3 shows current that flows in the light source unit 31 according to this embodiment. Section (B) in FIG. 3 shows current that flows in the light source unit 32 according to this embodiment. Section (C) in FIG. 3 shows total current that is supplied from the power supply unit 33 to the light source units 31 and 32 according to this embodiment. Section (D) in FIG. 3 shows current that flows in the light source unit 31 according to a comparison example. Section (E) in FIG. 3 shows current that flows in the light source unit 32 according to the comparison example. Section (F) in FIG. 3 shows total current that is supplied from a power supply unit to the light source units 31 and 32 according to the comparison example. Hereinafter, the driving operation of the light source units 31 and 32, according to this embodiment and the comparison example, will be described with reference to FIGS. 1 to 3.

As shown in FIG. 3, according to this embodiment, the control unit 34 determines, as drive periods of the light source units 31 and 32 in one frame period Tf, the drive period of the light source unit 31 to the drive period T1 and that of the light source unit 32 to the drive period T2. As FIG. 3 shows, T1<Tf and T2<Tf. According to this embodiment, in the one frame period Tf, the drive period T1 and the drive period T2 overlap by the overlapped period Ts in order to implement the light-up duty ratio that is set.

The control unit 34 drives to turn the light source unit 31 on first, and drives to turn the light source unit 32 on after the start of the driving of the light source unit 31, in conformity with the writing sequence of the image data to the pixels on the liquid crystal display panel 2 (that is, with the sequence from the top edge to the bottom edge in FIG. 2). In other words, the control unit 34 starts driving of the light source unit 31 to turn the light source unit 31 on when the one frame period Tf starts, and ends the driving of the light source unit 32 to turn the light source unit 31 off when the drive period T1 has elapsed. Further, the control unit 34 starts driving of the light source unit 32 to turn the light source unit 32 on at a point before the drive period T2 from the end of the one frame period Tf, and ends the driving of the light source unit 32 to turn the light source unit 32 off when the drive period T2 has elapsed (that is, when the one frame period Tf ends).

In this embodiment, the control unit 34 starts driving of the light source unit 31 when the one frame period Tf starts, but the present application is not limited to this. For example, the control unit 34 may start driving of the light source unit 31 after the one frame period Tf starts. In this embodiment, the control unit 34 ends driving of the light source unit 32 when the one frame period Tf ends, but the present application is not limited to this. For example, the control unit 34 may start driving of the light source unit 32 sooner so that driving of the light source unit 32 ends before the one frame period Tf ends.

First, operation of the comparison example will be described using sections (D) to (F) in FIG. 3. According to the comparison example, as shown in section (D) in FIG. 3, the constant current Ir is supplied to the light source unit 31 during the drive period T1. Also as shown in section (E) in FIG. 3, the constant current Ir is supplied to the light source unit 32 during the drive period T2. As a result, the light source units 31 and 32 turn on at a constant brightness corresponding to the constant current Ir. In this case, the power supply unit of the comparison example, which supplies current to the light source units 31 and 32, supplies current Ir to the light source unit 31 during the drive period T1, and supplies current Ir to the light source unit 32 during the drive period T2. As a result, the power supply unit of the comparison example supplies current 2Ir in total to the light source units 31 and 32 during the overlapped period Ts. This means that the power supply unit of the comparison example must have a capacity to supply the current 2Ir.

Next, operation of this embodiment will be described using sections (A) to (C) in FIG. 3. According to this embodiment, as shown in sections (A) and (B) in FIG. 3, the control unit 34 outputs a PWM signal, which repeats on and off with a predetermined pulse width Tp, to the light source units 31 and 32. By this PWM signal, the light source unit 31 repeats on and off with the pulse width Tp during the drive period T1, and the light source unit 32 repeats on and off with the pulse width Tp during the drive period T2. In other words, the control unit 34 sets the duty of the light source units 31 and 32 by the PWM signal to 50%. In this case, the control unit 34 outputs the PWM signal, of which peak value of the current to be supplied to the light source units 31 and 32 is 1.4Ir.

Here, the duty of the light source units 31 and 32 by the PWM signal is 50% in the overlapped period Ts. Therefore, the control unit 34 sets the peak value of the current to be supplied to the light source units 31 and 32 to 1.4Ir, whereby the effective value of the current to be supplied to the light source units 31 and 32 becomes the same as the case of supplying the constant current Ir. Hence the light source units 31 and 32 turn on at a brightness the same as the case of supplying the constant current Ir respectively in the overlapped period Ts.

In the overlapped period Ts, the control unit 34 outputs the PWM signal to the light source units 31 and 32 respectively with the phases of the PWM signals shifted to each other, so that the phase of on and off of the light source unit 31 and the phase of on and off of the light source unit 32 become the opposite. In other words, in the overlapped period Ts, the current is not supplied to the light source unit 31 and the light source unit 32, and the light source unit 31 and the light source unit 32 do not turn on simultaneously. As a result, the power supply unit 33 supplies the current 1.4Ir in total to the light source units 31 and 32 during the overlapped period Ts. This means that the power supply unit 33 must have the current capacity to supply the current 1.4Ir. This current capacity is 70% of the current capacity 2Ir that is required for the power supply unit of the comparison example.

Out of the drive period T1 of the light source unit 31, an effective value of the current that is supplied from the power supply unit 33 to the light source unit 31 during a period Tc1, other than the overlapped period Ts, is Ir, which is the same as the comparison example. Out of the drive period T2 of the light source unit 32, an effective value of the current that is supplied from the power supply unit 33 to the light source unit 32 during a period Tc2, other than the overlapped period Ts, is Ir, which is the same as the comparison example. In this embodiment, the light source unit 31 corresponds to an example of the first light source unit, the light source unit 32 corresponds to an example of the second light source unit, the drive period T1 corresponds to an example of the first drive period, and the drive period T2 corresponds to an example of the second drive period. The drive period T1 of the light source unit 31 includes a period when the light source unit 31 turns off by the PWM signal outputted from the control unit 34. In the same manner, the drive period T2 of the light source unit 32 includes a period when the light source unit 32 turns off by the PWM signal outputted from the control unit 34.

As described above, according to this embodiment, the control unit 34 outputs the PWM signal to the light source unit 31 during the drive period T1 of the light source unit 31, and outputs the PWM signal to the light source unit 32 during the drive period T2 of the light source unit 32. Further, the control unit 34 sets the phase of on and off of the PWM signal to be outputted to the light source unit 31 and that to be outputted to the light source unit 32 to be opposite from each other, during the overlapped period Ts. As a result, the current capacity required for the power supply unit 33 can be decreased compared with the power supply unit of the comparison example that supplies constant current. Therefore, according to this embodiment, the cost required for driving the light source units 31 and 32, such as the manufacturing cost of the power supply unit 33, can be decreased.

According to this embodiment, the peak value of the current to be supplied to the light source units 31 and 32 drops to 70% of the comparison example. As a result, the load fluctuation decreases compared with the comparison example. In other words, in the case of the comparison example, the current fluctuates between the current 2Ir and the current Ir, but in the case of this embodiment, the current fluctuates between the current 1.4Ir and the current Ir, that is, the load fluctuation of this embodiment is smaller than the load fluctuation of the comparison example. Hence, the power supply unit 33 can be more easily designed than the power supply unit of the comparison example, and design cost can be decreased.

According to this embodiment, the control unit 34 sets the peak value of the current to be supplied to the light source units 31 and 32 while supplying the PWM signal to a value 1.4 times that of the case of supplying constant current to the light source units 31 and 32. With this, a drop in brightness of the light source units 31 and 32 can be prevented even though the light source units 31 and 32 are driven while repeatedly being turned on and off by the PWM signal.

According to this embodiment, the control unit 34 sets the drive period T1 of the light source unit 31 in the one frame period Tf to T1<Tf, and turns the light source unit 31 off during the period other than the drive period T1. Further, the control unit 34 sets the drive period T2 of the light source unit 32 in the one frame period Tf to T2<Tf, and turns the light source unit 32 off during the period other than the drive period T2. With this, it is possible to realize a high video resolution.

In the operation in FIG. 3, the control unit 34 outputs the PWM signal to the light source unit 31 during the drive period T1 of the light source unit 31, and outputs the PWM signal to the light source unit 32 during the drive period T2 of the light source unit 32, but the present application is not limited to this. For example, the control unit 34 may output the PWM signal to the light source units 31 and 32 only during the overlapped period Ts.

Figure 4:
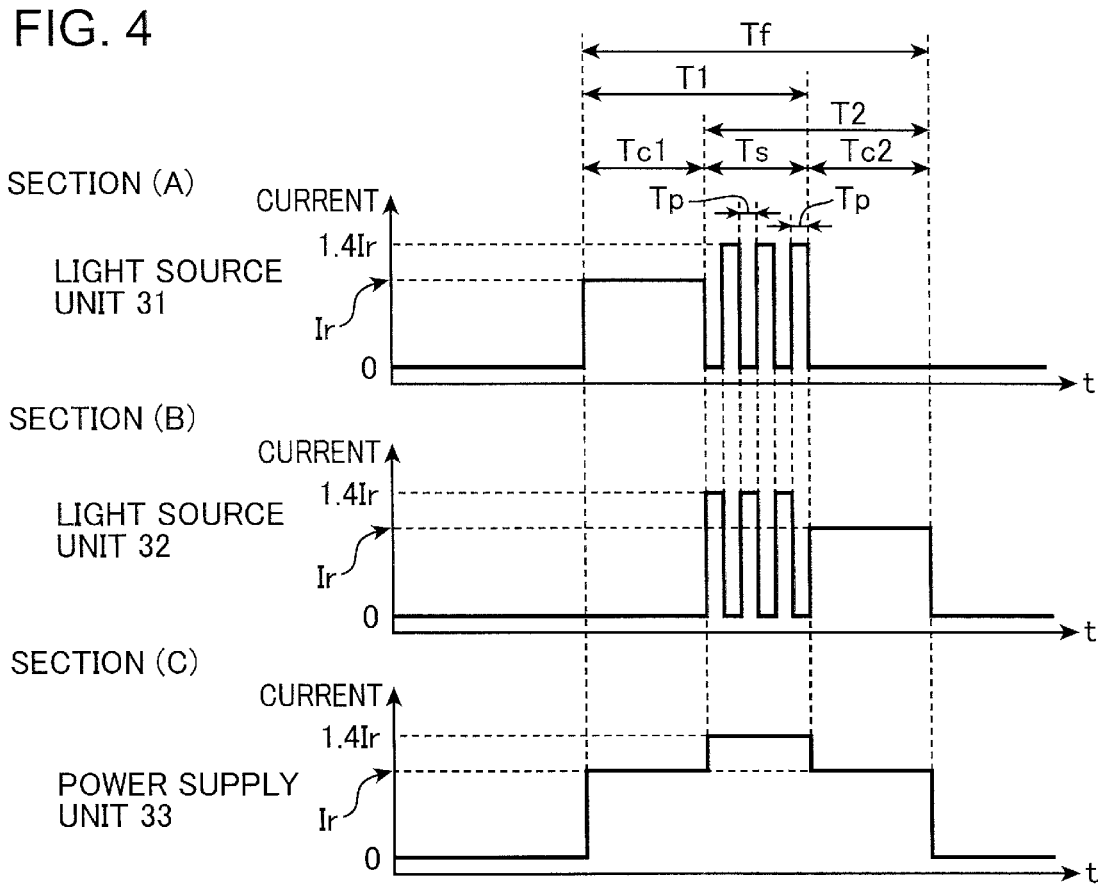
FIG. 4 is a timing chart depicting a modification of the operation of the light source units performed by the control unit in the display device shown in FIG. 1.

FIG. 4 is a timing chart depicting a modified embodiment of the operation of the light source units 31 and 32 performed by the control unit 34 in the display device shown in FIG. 1. Section (A) in FIG. 4 shows current that flows in the light source unit 31 according to this modified embodiment. Section (B) in FIG. 4 shows current that flows in the light source unit 32 according to this modified embodiment. Section (C) in FIG. 4 shows total current that is supplied from the power supply unit 33 to the light source units 31 and 32 according to this modified embodiment. Hereinafter, the driving operation of the light source units 31 and 32 according to this modified embodiment will be described with reference to FIGS. 1 and 4.

As shown in section (A) in FIG. 4, according to this modified embodiment, the control unit 34 outputs a rectangular wave signal to the light source unit 31 as a drive signal so that constant current Ir is supplied to the light source unit 31 during the period Tc1, other than the overlapped period Ts, in the drive period T1, and outputs the PWM signal to the light source unit 31 so that peak current 1.4Ir is supplied to the light source unit 31 only during the overlapped period Ts. Further, as shown in section (B) in FIG. 4, the control unit 34 outputs a rectangular wave signal to the light source unit 32 as a drive signal so that constant current Ir is supplied to the light source unit 32 during the period Tc2, other than the overlapped period Ts, in the drive period T2, and outputs the PWM signal to the light source unit 32 so that peak current 1.4Ir is supplied to the light source unit 32 only during the overlapped period Ts.

In this way, the operation shown in FIG. 4 is the same as the operation shown in FIG. 3, except that the control unit 34 outputs the PWM signal to the light source units 31 and 32 only during the overlapped period Ts. In other words, the light source units 31 and 32 are repeatedly turned on and off with the pulse width Tp by the PWM signal, respectively. At this time, the control unit 34 outputs the PWM signal so that the peak value of the current to be supplied to the light source units 31 and 32 is 1.4Ir. As a result, the effective value of the current to be supplied to the light source units 31 and 32 becomes the same as the case of supplying the constant current Ir. Hence, the light source units 31 and 32 are turned on at brightness the same as in the case where the rectangular wave signal is outputted from the control unit 34 as the drive signal, and the constant current Ir is supplied to the light source units 31 and 32 respectively.

Further, similarly to the operation shown in FIG. 3, in the overlapped period Ts, the control unit 34 outputs a PWM signal, with the phase thereof being shifted, to the light source units 31 and 32 respectively, so that the phase of on and off of the light source unit 31 and the phase of on and off of the light source unit 32 become the opposite. In other words, in the overlapped period Ts, current is not supplied to the light source unit 31 and the light source unit 32 simultaneously, and the light source unit 31 and the light source unit 32 are not turned on simultaneously. As a result, the power supply unit 33 supplies current 1.4Ir in total to the light source units 31 and 32 during the overlapped period Ts. Accordingly, it is necessary for the power supply unit 33 to have the current capacity to supply current 1.4Ir, as in the case of FIG. 3. This current capacity is 70% of the current capacity 2Ir that is required for the power supply unit of the comparison example described with reference to FIG. 3. In the operation shown in FIG. 4, the brightness of the light source unit 31, which is turned on by the current Ir supplied by the rectangular wave signal outputted from the control unit 34, corresponds to an example of the first brightness, the brightness of the light source unit 32, which is turned on by the current Ir supplied by the rectangular wave signal outputted from the control unit 34, corresponds to an example of the second brightness, the peak brightness of the light source unit 31, which is turned on by the peak current 1.4Ir supplied by the PWM signal outputted from the control unit 34, corresponds to an example of the brightness when the first light source unit is turned on, and the peak brightness of the light source unit 32, which is turned on by the peak current 1.4Ir supplied by the PWM signal outputted from the control unit 34, corresponds to an example of the brightness when the second light source unit is turned on.

As described above, according to the operation shown in FIG. 4 also, the current capacity required for the power supply unit 33 can be decreased compared with the comparison example shown in FIG. 3, as in the case of the operation shown in FIG. 3. Further, according to the operation shown in FIG. 4, a period when the peak current 1.4Ir is supplied to the light source unit 31 or 32 decreases compared with the operation shown in FIG. 3. As a result, according to the operation shown in FIG. 4, a drop in life of the light source units 31 and 32 can be suppressed, compared with the operation shown in FIG. 3.

(Second Embodiment)

In the above first embodiment, the backlight unit 3 has two light source units, that is, the light source unit 31 arranged along the top edge of the liquid crystal display panel 2, and the light source unit 32 arranged along the bottom edge of the liquid crystal display panel 2, but the present application is not limited to this. The backlight unit may have three or more light source units, for example.

Figure 5:
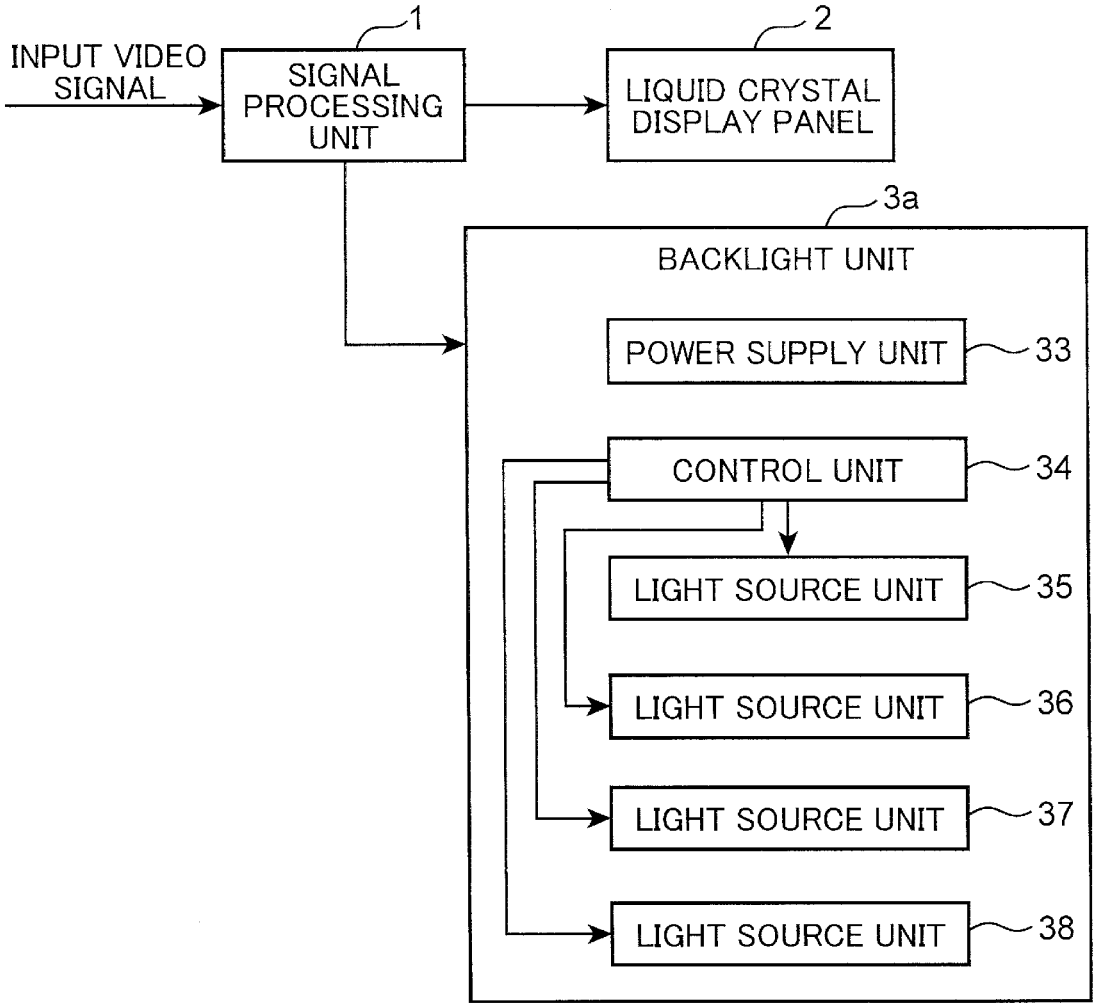
FIG. 5 is a block diagram depicting a configuration of a display device according to a second embodiment of the present application.
Figure 6:
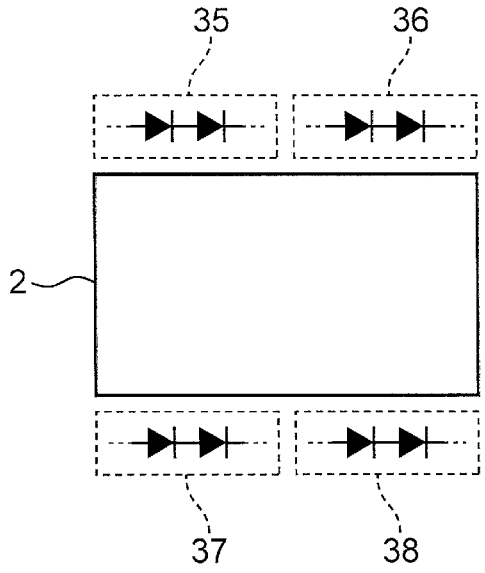
FIG. 6 is a schematic diagram depicting an arrangement of the light source units of the backlight unit according to the second embodiment.

FIG. 5 is a block diagram depicting a configuration of the display device according to a second embodiment of the present application. FIG. 6 is a schematic diagram depicting an arrangement of light source units of a backlight unit according to the second embodiment. In the second embodiment, a composing element similar to the first embodiment is denoted with a similar reference symbol. The display device of the second embodiment of the present application will now be described focusing on the differences from the first embodiment.

The display device of the second embodiment has a backlight unit 3*a* instead of the backlight unit 3, in the display device of the first embodiment. The backlight unit 3*a* has light source units 35, 36, 37 and 38 instead of the light source units 31 and 32, in the backlight unit 3 of the first embodiment. The rest of the configuration of the display device of the second embodiment is the same as the display device of the first embodiment shown in FIG. 1.

The light source units 35, 36, 37 and 38 have a similar configuration as the light source units 31 and 32 of the first embodiment. In other words, each of the light source units 35, 36, 37 and 38 includes a plurality of LEDs connected in series, for example. As FIG. 6 shows, the light source unit 35 is arranged in a left half portion of the top edge of the liquid crystal display panel 2, the light source unit 36 is arranged in a right half portion of the top edge of the liquid crystal display panel 2, the light source unit 37 is arranged in a left half portion of the bottom edge of the liquid crystal display panel 2, and the light source unit 38 is arranged in a right half portion of the bottom edge of the liquid crystal display panel 2.

Figure 7:
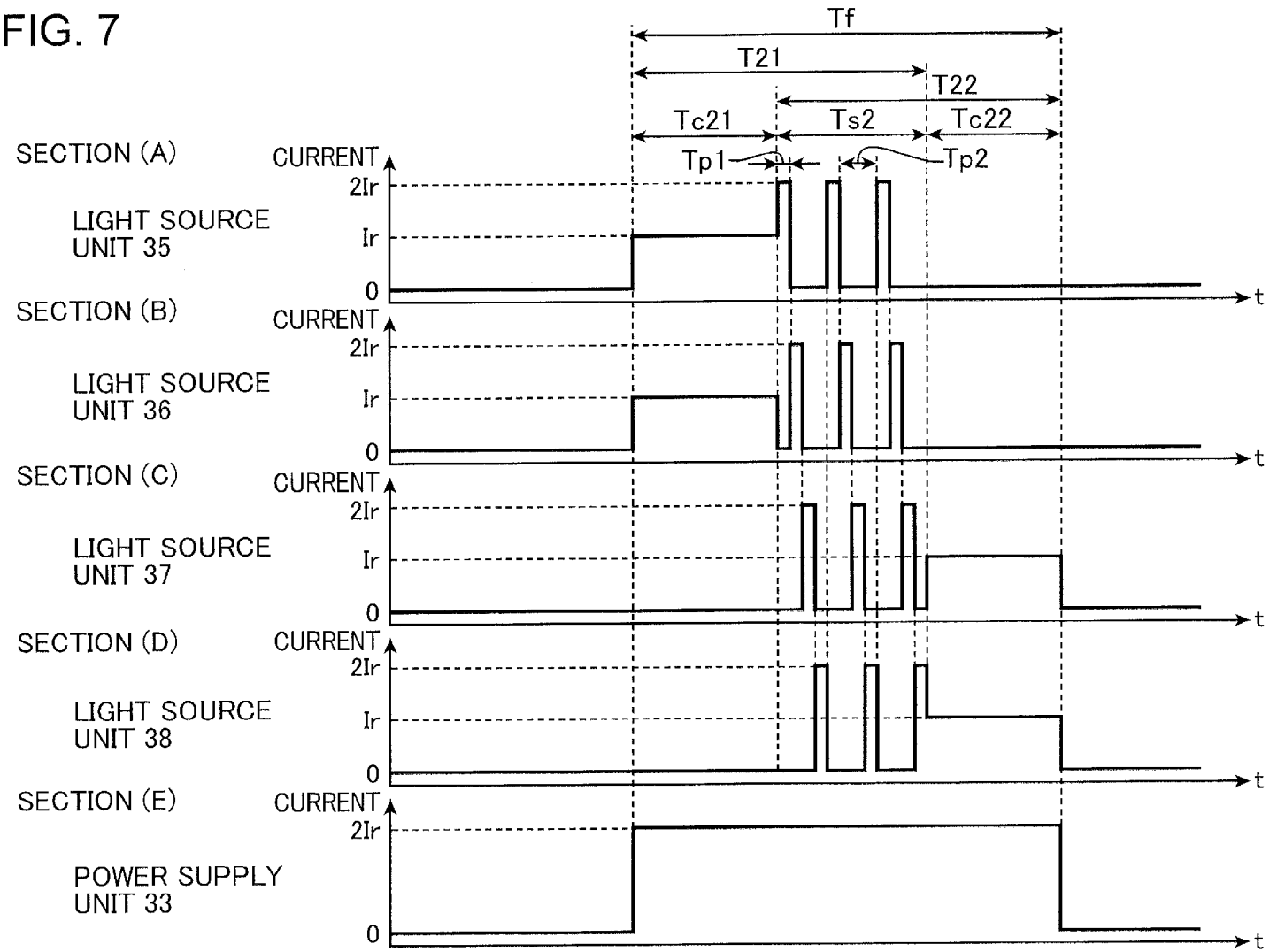
FIG. 7 is a timing chart depicting an example of the driving operation of the light source units performed by the control unit in the display device shown in FIG. 5.

FIG. 7 is a timing chart depicting an example of the drive operation of the light source units 35 to 38 performed by the control unit 34 of the display device shown in FIG. 5. Section (A) in FIG. 7 shows current that flows in the light source unit 35 according to this embodiment. Section (B) in FIG. 7 shows current that flows in the light source unit 36 according to this embodiment. Section (C) in FIG. 7 shows current that flows in the light source unit 37 according to this embodiment. Section (D) in FIG. 7 shows current that flows in the light source unit 38 according to this embodiment. Section (E) in FIG. 7 shows total current that is supplied from the power supply unit 33 to the light source units 35 to 38 according to this embodiment. Hereinafter, the driving operation of the light source units 35 to 38 according to this embodiment will be described with reference to FIGS. 5 to 7.

As shown in FIG. 7, according to this embodiment, the control unit 34 determines, as drive periods of the light source units 35 to 38 in one frame period Tf, the drive period of the light source units 35 and 36 to the drive period T21, and the drive period of the light source units 37 and 38 to the drive period T22. According to this embodiment, in the one frame period Tf, the drive period T21 and the drive period T22 overlap by the overlapped period Ts2, as shown in FIG. 7, in order to implement the light-up duty ratio that is set.

The control unit 34 drives to turn the light source units 35 and 36 on first, and drives to turn the light source units 37 and 38 on after the start of the driving of the light source units 35 and 36, in conformity with the writing sequence of the image data to the pixels on the liquid crystal display panel 2 (that is, with the sequence from the top edge to the bottom edge in FIG. 6). In other words, the control unit 34 starts driving of the light source units 35 and 36 to turn the light source units 35 and 36 on when the one frame period Tf starts, and ends the driving of the light source units 35 and 36 to turn the light source units 35 and 36 off when the drive period T21 has elapsed. Further, the control unit 34 starts driving of the light source units 37 and 38 to turn the light source units 37 and 38 on at a point before the drive period T22 from the end of the one frame period Tf, and ends the driving of the light source units 37 and 38 to turn the light source units 37 and 38 off when the drive period T22 has elapsed (that is, when the one frame period Tf ends). In this embodiment, the light source units 35 and 36 correspond to an example of the first light source unit, the light source units 37 and 38 correspond to an example of the second light source unit, the drive period T21 corresponds to an example of the first drive period, and the drive period T22 corresponds to an example of the second drive period.

In this embodiment, the control unit 34 starts driving of the light source units 35 and 36 to turn the light source units 35 and 36 on when the one frame period Tf starts, but the present application is not limited to this. For example, the control unit 34 may start driving of the light source units 35 and 36 to turn the light source units 35 and 36 on after the one frame period Tf starts. Further, the control unit 34 ends driving of the light source units 37 and 38 to turn the light source units 37 and 38 off when the one frame period Tf ends, but the present application is not limited to this. For example, the control unit 34 may start driving of the light source units 37 and 38 sooner so that driving of the light source units 37 and 38 ends before the one frame period Tf ends.

In this embodiment, as FIG. 6 shows, the plurality of LEDs of the light source unit 35 and the plurality of LEDs of the light source unit 36 are both arranged along the top edge of the liquid crystal display panel 2. Therefore, the light source units 35 and 36 are simultaneously driven and turned on and off in conformity with writing of image data to the pixels on the liquid crystal display panel 2. Hence, in this embodiment, the period when the light source units 35 and 36 are simultaneously driven is not called an overlapped period. In the same manner, in this embodiment, the period when the light source units 37 and 38 are simultaneously driven is not called an overlapped period.

In this embodiment, as shown in sections (A) and (B) in FIG. 7, the control unit 34 outputs the rectangular wave signal to the light source units 35 and 36 as the drive signal, during the period Tc21 other than the overlapped period Ts2 in the drive period T21, so that the constant current Ir is supplied to the light source units 35 and 36 respectively. Further, as shown in sections (C) and (D) in FIG. 7, the control unit 34 outputs the rectangular wave signal to the light source units 37 and 38 as the drive signal, during the period Tc22 other than the overlapped period Ts2 in the drive period T22, so that the constant current Ir is supplied to the light source units 37 and 38 respectively.

In the overlapped period Ts2, on the other hand, the control unit 34 outputs a PWM signal, in which on with a pulse width Tp1 and off with a pulse width Tp2 are repeated, to the light source units 35 to 38, as shown in sections (A) to (D) in FIG. 7. Here, the control unit 34 outputs the PWM signal to the light source units 35 to 38 so that the peak value of the current to be supplied to the light source units 35 to 38 during the on period becomes 2Ir. By this PWM signal, the light source units 35 to 38 repeat on and off such that they are turned on with the pulse width Tp1 and turned off with the pulse width Tp2, respectively. Further, the control unit 34 sets the pulse width Tp1 and Tp2 to be Tp2=3Tp1. In other words, the control unit 34 sets the duty of the light source units 35 to 38 by the PWM signal to 25%. With this, the control unit 34 outputs the PWM signal, in which the phases of on and off are shifted, to the light source units 35 to 38 respectively as shown in sections (A) to (D) in FIG. 7, so that the on periods of the light source units 35 to 38 are not overlapped with one another.

Here, the duty of the light source units 35 to 38 by the PWM signal is 25% in the overlapped period Ts2. Therefore, the control unit 34 sets the peak value of the current to be supplied to the light source units 35 to 38 to 2Ir, whereby the effective value of the current to be supplied to the light source units 35 to 38 becomes the same as in the case where the constant current Ir is supplied. Hence, the light source units 35 to 38 are respectively turned on, in the overlapped period Ts2, at brightness the same as in the case where the constant current Ir is supplied.

Therefore, in the overlapped period Ts2, current is not supplied to the light source units 35 to 38 simultaneously, and the light source units 35 to 38 are not turned on simultaneously. Because of this, the power supply unit 33 supplies the current 2Ir in total to the light source units 35 to 38 during the overlapped period Ts2. As a result, it is necessary for the power supply unit 33 to have the current capacity to supply the current 2Ir.

On the other hand, as can be understood from FIG. 7, in a case where the constant current Ir is supplied to the light source units 35 and 36 similarly to the period Tc21, and the constant current Ir is supplied to the light source units 37 and 38 similarly to the period Tc22 in the overlapped period Ts2, without the PWM signal being outputted to the light source units 35 to 38, it will be necessary for the power supply unit 33 to have the current capacity to supply the current 4Ir. As a consequence, according to the operation of the second embodiment shown in FIG. 7, current capacity required for the power supply unit 33 can be decreased, as in the case of the first embodiment.

(Others)

In the operation shown in FIGS. 3 and 4 of the above first embodiment, the peak current when the PWM signal is outputted is 1.4Ir, but the present application is not limited to this. The peak current may be KIr ($1<K<2$) instead of 1.4Ir, and the value K may be set according to the characteristics of the LEDs of the light source units 31 and 32. In the same manner, in the operation shown in FIG. 7 of the above second embodiment, the peak current when the PWM signal is outputted is 2Ir, but the present application is not limited to this. The peak current may be LIr ($1<L<4$) instead of 2Ir, and the value L may be set according to the characteristics of the LEDs of the light source units 35 to 38.

In the operation shown in FIGS. 3 and 4 of the above first embodiment, the control unit 34 causes the phases of on and off of the PWM signals to be opposite when outputting the PWM signals, so that the on periods of the light source units 31 and 32 do not overlap each other, but the present application is not limited to this. The on periods of the light source units 31 and 32 may overlap somewhat. In this modification, the control unit 34 simply shifts the phases of on and off of the PWM signals to be outputted to the light source units 31 and 32.

Similarly, in the operation shown in FIG. 7 of the above second embodiment, the control unit 34 sets the pulse width Tp1 and Tp2 to be Tp2=3Tp1 and shifts the phases of on and off of the PWM signals when outputting the PWM signals, so that the on periods of the light source units 35 to 38 do not overlap one another at all, but the present application is not limited to this. The on periods of two light source units, for example, out of the light source units 35 to 38, may overlap each other somewhat. In this modification, the control unit 34 simply shifts the phases of on and off of the PWM signals to be outputted to the light source units 35 to 38.

In the above first and second embodiments, the light source units 31, 32 and 35 to 38 include light emitting diodes respectively, but the present application is not limited to this. For example, the light source units 31, 32 and 35 to 38 may include light emitting elements other than light emitting diodes, such as cold cathode fluorescent tubes.

The above-described concrete embodiments mainly include a display device and a method for controlling the display device having the following configurations.

In one general aspect, the present application describes a display device includes a display panel that displays a frame image for each one frame period; and a backlight unit that illuminates the display panel from a rear face of the display panel, wherein the backlight unit includes: a first light source unit that illuminates the display panel; a second light source unit that illuminates the display panel; and a control unit that outputs a drive signal to the first light source unit to drive the first light source unit during a first drive period in the one frame period, and a drive signal to the second light source unit to drive the second light source unit during a second drive period in the one frame period after the driving of the first light source unit is started, and the control unit: drives the first light source unit and the second light source unit so that the one frame period has an overlapped period, in which the first drive period and the second drive period overlap each other; outputs a PWM signal as the drive signal to the first light source unit in the overlapped period, and a PWM signal as the drive signal to the second light source unit in the overlapped period, each of the PWM signals turning the first light source unit and the second light source unit on and off with a predetermined pulse width; and shifts a phase of the PWM signal to be outputted to the first light source unit and a phase of the PWM signal to be outputted to the second light source unit from each other.

According to this configuration, the display panel displays a frame image for each one frame period. The backlight unit illuminates the display panel from the rear face of the display panel. The first light source unit illuminates the display panel. The second light source unit is provided separately from the first light source unit, and illuminates the display panel. The control unit outputs a drive signal to the first light source unit to drive the first light source unit during a first drive period in the one frame period. The control unit outputs a drive signal to the second light source unit to drive the second light source unit during a second drive period in the one frame period after the driving of the first light source unit is started. The first light source unit is turned off during a period other than the first drive period in the one frame period, and the second light source unit is turned off during a period other than the second drive period in the one frame period, whereby high video resolution can be realized. The control unit drives the first light source unit and the second light source unit so that the one frame period has an overlapped period, in which the first drive period and the second drive period overlap each other. The control unit outputs a PWM signal as the drive signal to the first light source unit in the overlapped period. The control unit outputs a PWM signal as the drive signal to the second light source unit in the overlapped period. Each of the PWM signals turns the first light source unit and the second light source unit on and off with a predetermined pulse width. The control unit shifts a phase of the PWM signal to be outputted to the first light source unit and a phase of the PWM signal to be outputted to the second light source unit from each other. Accordingly, the degree of increase of the current capacity required for driving the first light source unit and the second light source unit can be decreased compared with the case where the first light source unit and the second light source unit are turned on at a constant brightness and drive periods overlap, even though the one frame period has an overlapped period, since the phase of the PWM signal to be outputted to the first light source unit and the phase of the PWM signal to be outputted to the second light source unit are shifted from each other. Therefore, even though the one frame period has the overlapped period, an increase of current capacity required for driving the first light source unit and the second light source unit can be suppressed, compared with the case where the one frame period does not have the overlapped period. As a result, an increase in the cost required for driving the first light source unit and the second light source unit can be suppressed, and the load on the power supply unit can be decreased.

The above general aspect may include one or more of the following features. The control unit may shift the phase of the PWM signal to be outputted to the first light source unit and the phase of the PWM signal to be outputted to the second light source unit from each other, so that an on period of the first light source unit and an on period of the second light source unit do not overlap in the overlapped period.

According to this configuration, the control unit shifts the phase of the PWM signal to be outputted to the first light source unit and the phase of the PWM signal to be outputted to the second light source unit from each other, so that an on period of the first light source unit and an on period of the second light source unit do not overlap in the overlapped period. Therefore, the first light source unit and the second light source unit are not simultaneously turned on. Hence, even though the one frame period has an overlapped period, the current capacity required for driving the first light source unit and the second light source unit can be approximately the same as in the case where the one frame period does not have the overlapped period. As a result, the increase in the cost required for driving the first light source unit and the second light source unit can be prevented.

The control unit may output the PWM signal to the first light source unit during the first drive period, and may output the PWM signal to the second light source unit during the second drive period.

According to this configuration, the control unit outputs the PWM signal to the first light source unit during the first drive period, and outputs the PWM signal to the second light source unit during the second drive period. Therefore, the control unit always outputs the PWM signal when driving the first light source unit and the second light source unit. Hence, according to this configuration, the control configuration can be simplified.

The control unit may output, as the drive signal, a rectangular wave signal to the first light source unit during a period other than the overlapped period in the first drive period, to drive the first light source unit so that a current value of the first light source unit becomes a first current value; and may output, as the drive signal, a rectangular wave signal to the second light source unit during a period other than the overlapped period in the second drive period, to drive the second light source unit so that a current value of the second light source unit becomes a second current value.

According to this configuration, the control unit outputs, as the drive signal, a rectangular wave signal to the first light source unit during a period other than the overlapped period in the first drive period, to drive the first light source unit so that a current value of the first light source unit becomes the first current value. The control unit outputs, as the drive signal, a rectangular wave signal to the second light source unit during a period other than the overlapped period in the second drive period, to drive the second light source unit so that a current value of the second light source unit becomes the second current value. In a case where the PWM signal is outputted to the first light source unit and the second light source unit to turn the first light source unit and the second light source unit on and off with a predetermined pulse width, the brightness of the first light source unit and the second light source unit is likely to drop. However, with the above-described configuration, in a period other than the overlapped period in the first drive period, the first light source unit is driven by the rectangular wave signal so that the current value of the first light source unit becomes the first current value, and in a period other than the overlapped period in the second drive period, the second light source unit is driven by the rectangular wave signal so that the current value of the second light source unit becomes the second current value. Therefore, a drop in brightness of the first light source unit and that of the second light source unit can be suppressed.

The control unit may increase, when outputting the PWM signal, a current value to be larger than the first current value when the first light source unit is on, and may increase, when outputting the PWM signal, a current value to be larger than the second current value when the second light source unit is on.

According to this configuration, the control unit increases, when outputting the PWM signal, a current value to be larger than the first current value when the first light source unit is on. The control unit increases, when outputting the PWM signal, a current value to be larger than the second current value when the second light source unit is on. Accordingly, it is possible not to drop the brightness of the first light source unit and that of the second light source unit, even though the PWM signal is outputted to the first light source unit and the second light source unit to turn the first light source unit and the second light source unit on and off with a predetermined pulse width.

The control unit may set a current value of the first light source unit so that an effective value of the current of the first light source unit becomes constant during the first drive period, and sets a current value of the second light source unit so that an effective value of the current of the second light source unit becomes constant during the second drive period.

According to this configuration, the control unit sets a current value of the first light source unit so that an effective value of the current of the first light source unit becomes constant during the first drive period. The control unit sets a current value of the second light source unit so that an effective value of the current of the second light source unit becomes constant during the second drive period. Accordingly, the brightness of the first light source unit and that of the second light source unit can be constant during the respective drive periods.

The first light source unit and the second light source unit may include light emitting diodes respectively.

According to this configuration, the first light source unit and the second light source unit include light emitting diodes respectively. The response of the light emitting diodes to a drive signal is extremely fast. Therefore, when the PWM signal is outputted to the first light source unit and the second light source unit from the control unit, the light emitting diodes in the first light source unit and the second light source unit can be appropriately turned on and off with a predetermined pulse width.

An another general aspect may include a method for controlling a display device that has a display panel which displays a frame image for each one frame period, and a backlight unit that illuminates the display panel from a rear face of the display panel, the backlight unit including a first light source unit that illuminates the display panel, and a second light source unit that illuminates the display panel, the method comprising: a first step of outputting a drive signal to the first light source unit to drive the first light source unit during a first drive period in the one frame period; and a second step of outputting a drive signal to the second light source unit to drive the second light source unit during a second drive period in the one frame period after the driving of the first light source unit is started, wherein the first light source unit and the second light source unit are driven in the first step and the second step so that the one frame period has an overlapped period, in which the first drive period and the second drive period overlap each other, a PWM signal is outputted, as the drive signal, to the first light source unit in the overlapped period in the first step, the PWM signal turning the first light source unit on and off with a predetermined pulse width, a PWM signal is outputted, as the drive signal, to the second light source unit in the overlapped period in the second step, the PWM signal turning the second light source unit on and off with a predetermined pulse width, and a phase of the PWM signal to be outputted to the first light source unit and a phase of the PWM signal to be outputted to the second light source unit are shifted from each other in the first step and the second step.

According to this configuration, in the first step, the drive signal is outputted to the first light source unit to drive the first light source unit during the first drive period in the one frame period. In the second step, the drive signal is outputted to the second light source unit to drive the second light source unit during the second drive period in the one frame period after the driving of the first light source unit is started. In the one frame period, the first light source unit is turned off during a period other than the first drive period, and the second light source unit is turned off during a period other than the second drive period, whereby high video resolution can be implemented. In the first step and the second step, the first light source unit and the second light source unit are driven so that the one frame period has an overlapped period, in which the first drive period and the second drive period overlap. In the overlapped period in the first step, the PWM signal to turn the first light source unit on and off with a predetermined pulse width is outputted to the first light source unit as the drive signal. In the overlapped period in the second step, the PWM signal to turn the second light source unit on and off with a predetermined pulse width is outputted to the second light source unit as the drive signal. In the first step and the second step, a phase of the PWM signal to be outputted to the first light source unit and a phase of the PWM signal to be outputted to the second light source unit are shifted from each other. Accordingly, since the phase of the PWM signal to be outputted to the first light source unit and the phase of the PWM signal to be outputted to the second light source unit are shifted from each other, even though the one frame period has the overlapped period, the degree of increase of the current capacity required for the first light source unit and the second light source unit can be decreased compared with the case where the first light source unit and the second light source unit are turned on at a predetermined brightness and drive periods overlap. Therefore, even though the one frame period has the overlapped period, an increase of current capacity required for driving the first light source unit and the second light source unit can be suppressed compared with the case where the one frame period does not have the overlapped period. As a result, an increase in the cost required for driving the first light source unit and the second light source unit can be suppressed, and the load on the power supply unit can be decreased.

INDUSTRIAL APPLICABILITY

The present disclosure is useful, in a display device having a display panel that displays a frame image and a backlight unit that illuminates the display panel from the rear face, as a display device and a method for controlling the display device which can suppress an increase in the cost required for driving light source units.

This application is based on Japanese Patent application No. 2012-098561 filed in Japan Patent Office on Apr. 24, 2012, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A display device, comprising:

a display panel that displays a frame image for each one frame period; and a backlight unit that illuminates the display panel from a rear face of the display panel, wherein the backlight unit includes:

a first light source unit that illuminates the display panel;

a second light source unit that illuminates the display panel; and a control unit that outputs a drive signal to the first light source unit to drive the first light source unit during a first drive period in the one frame period, and a drive signal to the second light source unit to drive the second light source unit during a second drive period in the one frame period after the driving of the first light source unit is started, and the control unit:

drives the first light source unit and the second light source unit so that the one frame period has an overlapped period, in which the first drive period and the second drive period overlap each other;

outputs a PWM signal as the drive signal to the first light source unit in the overlapped period, and a PWM signal as the drive signal to the second light source unit in the overlapped period, each of the PWM signals turning the first light source unit and the second light source unit on and off with a predetermined pulse width;

shifts a phase of the PWM signal to be outputted to the first light source unit and a phase of the PWM signal to be outputted to the second light source unit from each other, outputs, as the drive signal, a rectangular wave signal to the first light source unit during a period other than the overlapped period in the first drive period, to drive the first light source unit so that a current value of the first light source unit becomes a first current value; and outputs, as the drive signal, a rectangular wave signal to the second light source unit during a period other than the overlapped period in the second drive period, to drive the second light source unit so that a current value of the second light source unit becomes a second current value, wherein the control unit increases, when outputting the PWM signal, a current value to be larger than the first current value when the first light source unit is on, and increases, when outputting the PWM signal, a current value to be larger than the second current value when the second light source unit is on, each of the periods other than the overlapped period in the first drive period is longer than each period of the PWM signals turning the first light source unit on, and each of the periods other than the overlapped period in the second drive period is longer than each period of the PWM signals turning the second light source unit on.

2. The display device according to claim 1, wherein the control unit shifts the phase of the PWM signal to be outputted to the first light source unit and the phase of the PWM signal to be outputted to the second light source unit from each other, so that an on period of the first light source unit and an on period of the second light source unit do not overlap in the overlapped period.

3. The display device according to claim 1, wherein the control unit outputs the PWM signal to the first light source unit during the first drive period, and outputs the PWM signal to the second light source unit during the second drive period.

4. The display device according to claim 1, wherein the control unit sets a current value of the first light source unit so that an effective value of the current of the first light source unit becomes constant during the first drive period, and sets a current value of the second light source unit so that an effective value of the current of the second light source unit becomes constant during the second drive period.

5. The display device according to claim 1, wherein the first light source unit and the second light source unit include light emitting diodes respectively.

* * * * *